United States Patent [19]

Bethea

[11] Patent Number: 4,755,691

[45] Date of Patent: Jul. 5, 1988

[54] PORTABLE, MODULAR, SMALL APPLIANCE CONTROL SYSTEM

[76] Inventor: Duke O. Bethea, 317 Wildbrook La., Birmingham, Ala. 35216

[21] Appl. No.: 869,618

[22] Filed: Jun. 2, 1986

[51] Int. Cl.[4] ..... H01H 3/26; H01H 47/28

[52] U.S. Cl. ..... 307/114; 307/140; 307/38; 315/361; 361/191

[58] Field of Search ..... 361/189, 191; 307/23, 307/18, 113–115, 140, 139, 38, 80, 112; 315/361

[56] References Cited

U.S. PATENT DOCUMENTS

| | | | |
|---|---|---|---|
| 342,549 | 5/1886 | Ward et al. | 361/361 |
| 3,424,919 | 1/1969 | Howlett | 307/140 |
| 3,872,319 | 3/1975 | Platzer, Jr. | 307/114 |
| 4,011,482 | 3/1977 | Seib | 315/361 |
| 4,090,107 | 5/1978 | Seib | 315/156 |
| 4,578,593 | 3/1986 | Davidov | 307/114 X |

*Primary Examiner*—A. D. Pellinen
*Assistant Examiner*—Todd E. DeBoer
*Attorney, Agent, or Firm*—Wm. Randall May

[57] ABSTRACT

A portable, modular small appliance control system for lamps and the like, which allows separate control of each outlet of a multiple outlet receptacle from separate and remote locations.

10 Claims, 1 Drawing Sheet

PORTABLE, MODULAR, SMALL APPLIANCE CONTROL SYSTEM

BACKGROUND OF THE INVENTION

Convenience has become a major factor influencing the quality of modern-day living. The ever-expanding array of labor-saving devices has taken the drudgery out of our lives, so to further improve our life styles, we turn to items which offer convenience.

The American lifestyle has become ever-hurried as people struggle to keep up with harried work and personal schedules. Out of this frantic pace has emerged a desire not only for labor-saving devices to take the drudgery out of our lives, but also for items which offer us the luxury of convenience.

One such area which is open to improvements in convenience concerns the placement of electrical outlets and switches in our homes. Is there anyone who has not experienced the inconvenience of sitting down in a comfortable chair and reaching up to turn on a light on the end table, only to realize that the outlet to which the lamp is attached has been switched off at a switch on the other side of the room.

Many couples frequently face a similar problem. The bedroom is designed around a large double bed, with a night stand and small reading lamp on each side. One partner goes directly to sleep, while the other stays up to read. The first partner awakes in the middle of the night to find that her spouse has fallen asleep with his light still on. The first partner now has three choices: (1) wake her husband and tell him to turn off the light; (2) crawl over him to turn it off herself; or (3) get out of bed to walk around the room to the other side of the bed to turn off the lamp, and then walk back in the dark and get into bed. None of these options can be considered convenient.

The placement of electrical outlets and switches causes other inconveniences: an appliance which itself has no on/off switch (i.e., electric curlers) is virtually impossible to use in outlets behind heavy furniture such as a dresser, though that may be the most practical place to use the appliance; appliances for room temperature comfort, such as electric space heaters and fans, cannot be operated from the bed, chair or sofa unless they are within arm's reach, which is usually not the best place for optimum enjoyment of such a device.

Similarly, when the phone rings, even if it is right beside a person's chair, if th television or stereo is on, he still has to get up to turn it off before answering the telephone in order to hear the caller. While television sets with remote control offer one solution to this problem, most people cannot afford to buy new television sets solely for such a reason.

Some members for the population have special problems with electrical outlet and switch placements: the sick, disabled, handicapped and/or elderly are often unable to reach the outlets and switches at all; making ordinary wall light switches unsurmountable obstacles, and crawling behind or under furniture to get to outlets unthinkable. In addition, a signal device such as a bell or buzzer may be plugged in one side of the outlet. Small children face similar problems as well as others: for example, wanting to have their bedside lamp left on until they fall asleep, but often being awakened when the parent comes into turn it off.

As is well known in the art to which my invention relates (refer to U.S. Pat. Nos. 4,090,107, 4,011,482, 3,872,319 and 342,549), there have been several devices proposed to control switches or to turn on devices from remote areas, but they do not use switches which reverse the energization status of the load, with the exception of one: U.S. Pat. No. 4,090,107 accomplishes this reversal, but does so through integrated circuits, not relays.

SUMMARY OF THE INVENTION

In accordance with my present invention, I overcome the above and other difficulties by providing a convenient, portable means for changing the placement of electrical outlets and switches to suit any particular individual or furniture arrangement.

It is another object of this invention to provide an inherently safe, low voltage control system for said portable means.

It is yet another object of this invention to provide a portable, modular low voltage control which allows complete and independent control of both sides of a duplex outlet receptacle from two separate and remote switch locations.

Also, my improved device embodies relays which allow for its inexpensive and simple construction, as well as being portable.

DETAILED DESCRIPTION OF THE DRAWINGS

Figure 1:
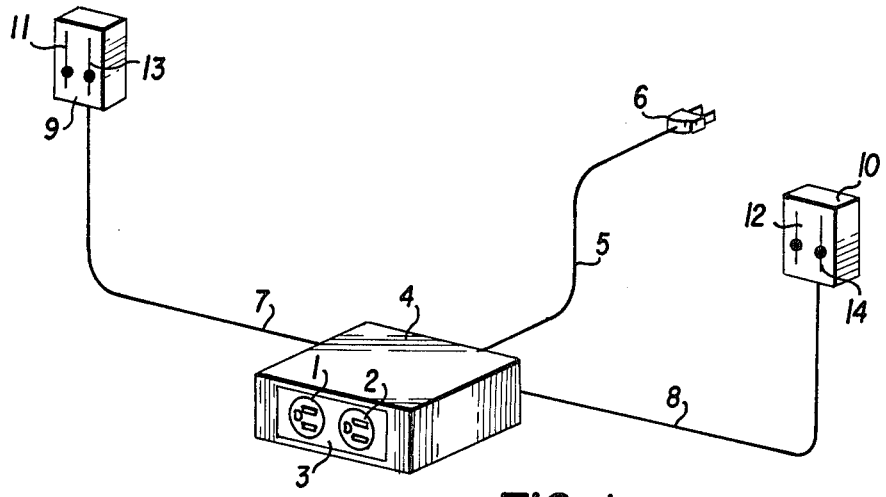
FIG. 1 is a pictorial view of the elements of the invention.

Referring to FIG. 1, there is presented a pictorial view of the physical elements of the invention. Outlet receptacles 1 and 2 are shown surrounded by mounting plate 3 on duplex outlet receptacle housing 4. This assembly is connected to a source of alternating current through power cord 5 and plug 6. Also attached to housing 4 are cords 7 and 8, leading to remote switch boxes 9 and 10, respectively, each of which has a pair of switches 11 and 13 and 12 and 14, respectively.

Figure 1A:
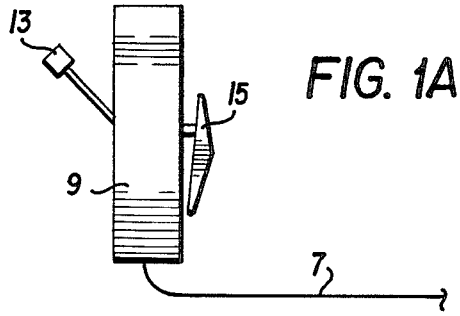
FIG. 1*a* is a side plan view of one of the switch housings.

FIG. 1*a* shows a side view of switch box 9, revealing a mounting clip 15 to allow the box to be conveniently attached to a bed frame, blanket, end table, sofa or chair arm or the like.

Figure 2:
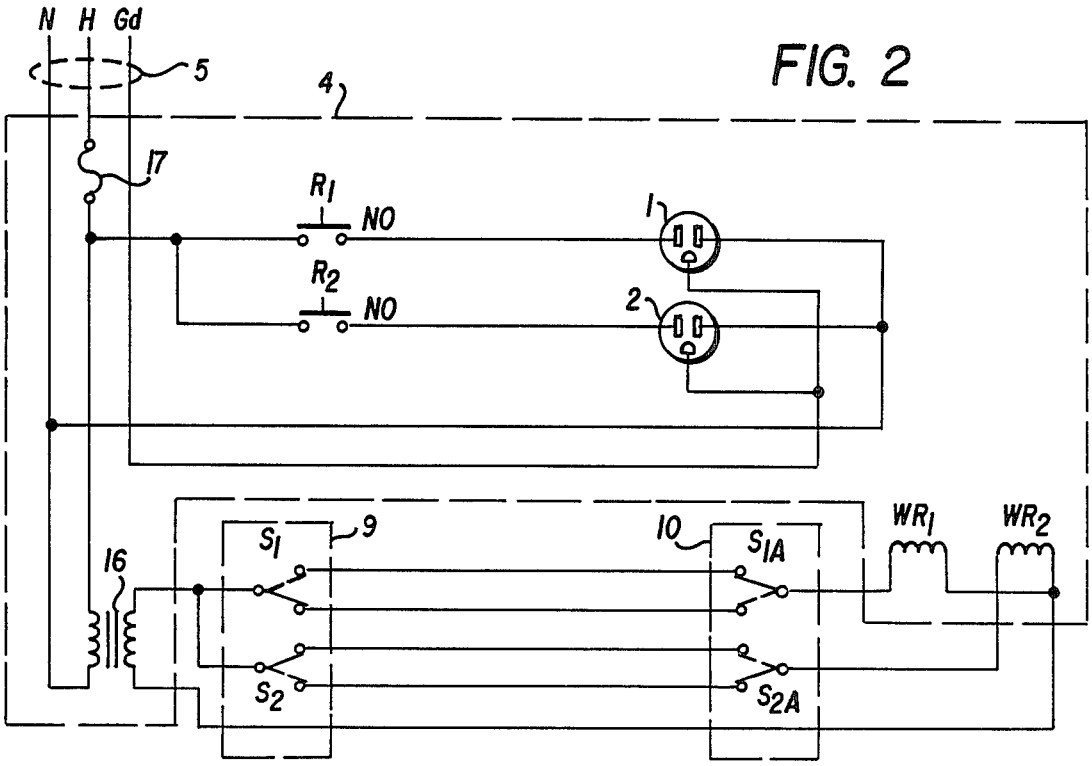
FIG. 2 is a schematic diagram of the circuitry of the invention.

Referring now to FIG. 2, duplex outlet receptacle housing 4 is shown attached through power cord 5 (containing neutral N, hot H and ground Gd. wires) to a source of alternating current. Within housing 4 are contained normally open power relays R1 and R2, their repective control windings WR1 and WR2, stepdown transformer 16 and safety fuse 17, as well as outlet receptacles 1 and 2.

Stepdown transformer 16 provides a 12 volt supply of power, down from the standard line source of 120 volts, to the switch pairs in the switch boxes 9 and 10. These four single pole, double throw switches, S1 and S2 (11 and 13, FIG. 1), S1A and S2A (12 and 14, FIG. 1), control the application of current to the control windings WR1 and WR2, and thus effect control of any loads connected to outlet receptacles 1 and 2. The switch pairs S1, S1A and S2, S2A are wired in a two-way configuration such that said switches in either switch box 9 or 10 can control the energizing or de-energizing of either control relay, and thus control any loads attached to outlets 1 and 2.

The utilization and operation of the device of this invention is as follows:

Power cord 5 and plug 6 attached to housing 4 are connected to a source of alternating line current. Load means (not shown) are plugged into outlet receptacles 1 and 2. Switch boxes 9 and 10 may be located anywhere for convenient switching of the load means. For example, the loads may be two bedside lamps, one mounted on each of two nightstands placed on either side of a double bed. Switch boxes 9 and 10 can then be placed on nightstands, or attached by means of clips 15 to the double frame or the like. It can be seen clearly from the wiring schematic of FIG. 2 that both switches S1 (11, FIG. 1) and S1A (12, FIG. 1) have full control of the energization and de-energization of control winding WR1, and thereby control the opening and closing of the relay contacts R1 which in turn control the energization and de-energization of any load connected to outlet receptacle 1. Likewise, both switches S2 (13, FIG. 1 and FIG. 1*a*) and S2A (14, FIG. 1) have full control of the energization and de-energization of control winding WR2, and thus control relay contacts R2 which in turn similarly control any load connected to outlet receptacle 2.

Continuing with the example begun above, both partners sleeping in a double bed can now control both lamps on either side of the bed from their conveniently mounted switch boxes.

Safety of the system is assured through the use of the 12 volt stepdown transformer 16. The standard 120 volt line source is contained entirely within the duplex receptacle housing 4, and is of course supplied to the load devices through outlets 1 and 2. The power supplied to the remotely mounted switch boxes, the only parts normally accessed by the users, 7, 8, 9, 10, 11, 12, 13, 14, is only 12 volts. As a further safety precaution, a line fuse 17 is placed in line with the power cord 5 to protect against line faults and the like.

I claim:

1. A portable, modular control means comprising: multiple power relays each having a control winding and multiple contacts whereby the contacts of said relays are connected to a source of electrical power and to respective load means;

and multiple sets of switch means at locations remote from one another, whereby each set of said sets controls the switching state of all of said contacts from all of said locations of said switch means by said switch means controlling the application of said power to and removal of said power from said control windings of said relays.

2. A portable, modular control means as claimed in claim 1, wherein:

said sets are mounted within a housing.

3. A housing, as claimed in claim 2, wherein:

a clip is mounted on an exterior side of said housing for attachment to a support means.

4. A portable, modular control means as claimed in claim 1, wherein:

a step-down transformer having a primary winding and a secondary winding whereby said primary winding is connected, in series, to said switch means and to said control windings.

5. A portable, modular control means as claimed in claim 1 wherein:

said switch means are not only located remote from one another but are also located remote from said relays.

6. A portable, modular control means for a duplex outlet receptacle, comprising:

two power relays each having a control winding and multiple contacts whereby the contacts of said relays are connected to a source of alternating electrical power and to respective load means; and two pairs of switch means at locations remote from one another whereby each set of said pairs controls the switching state of each contact from both locations by said switch means controlling the application of said power to and the removal of said power from said control winding of said relays.

7. A portable, modular control means as claimed in claim 6, wherein:

said switch means are mounted within a housing.

8. A housing, as claimed in claim 7, wherein: a clip is mounted on an exterior side of said housing for attachment to a support means.

9. A portable, modular control means as claimed in claim 6, wherein:

a step-down transformer having a primary winding and a secondary winding whereby said primary winding is connected to said source and said secondary winding is connected, in series, to said switch means and to said control windings.

10. A portable, modular control means as claimed in claim 6, wherein:

said switch means are not only located remote from each other but are also located remote from said relays.

* * * * *